US006973788B2

(12) United States Patent
Oda et al.

(10) Patent No.: US 6,973,788 B2
(45) Date of Patent: Dec. 13, 2005

(54) STEAM ENGINE

(75) Inventors: Shuzo Oda, Kariya (JP); Shinichi Yatsuzuka, Chiryu (JP); Yasumasa Hagiwara, Kariya (JP); Toshiyuki Morishita, Nagoya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/073,483

(22) Filed: Mar. 4, 2005

(65) Prior Publication Data

US 2005/0193737 A1 Sep. 8, 2005

(30) Foreign Application Priority Data

Mar. 5, 2004 (JP) ..... 2004-063014

(51) Int. Cl.[7] ..... F01K 13/00
(52) U.S. Cl. ..... 60/645; 60/660; 60/670
(58) Field of Search ..... 60/643, 645, 660, 60/670

(56) References Cited

U.S. PATENT DOCUMENTS 4,241,722 A * 12/1980 Dickinson ..... 126/263.01
4,272,383 A * 6/1981 McGrew ..... 210/741
5,008,085 A * 4/1991 Bain et al. ..... 422/109
5,160,581 A * 11/1992 Titmas ..... 162/61
5,879,637 A * 3/1999 Titmas ..... 422/129
6,238,568 B1 * 5/2001 Hazlebeck ..... 210/697
6,733,667 B2 * 5/2004 Max ..... 210/177
2004/0060294 A1 4/2004 Yatsuzuka et al.

FOREIGN PATENT DOCUMENTS

JP 7-180649 7/1995

* cited by examiner

*Primary Examiner*—Hoang Nguyen
(74) *Attorney, Agent, or Firm*—Harness, Dickey & Pierce, PLC

(57) ABSTRACT

A stem engine has a fluid container, a heating device and a cooling device. The fluid container has an outer pipe having an upper closed end, and an inner pipe provided in the outer pipe and having a fluid inlet port through which the inside of the inner pipe is operatively communicated with the outside of the inner pipe. The inner pipe has a pressure control device at its lower end, and a fluid injection port at its upper end for injecting the working fluid in the inner pipe into a space defined between the inner pipe and the outer pipe, when the pressure in the inner pipe is increased. The working fluid injected into the space between the inner and outer pipes is heated and vaporized by the heating device, so that volumetric expansion of the working fluid takes place to increase fluid pressure in the fluid container. The vaporized steam is then cooled and liquidized by the cooling device and thereby the volumetric contraction takes place, so that the fluid pressure is decreased. By repeating the above volumetric expansion and contraction of the working fluid, the pressure change is given to the working fluid in the fluid container.

24 Claims, 5 Drawing Sheets

STEAM ENGINE

CROSS REFERENCE TO RELATED APPLICATION

This application is based on Japanese Patent Application No. 2004-063014 filed on Mar. 5, 2004, the disclosure of which is incorporated herein by reference.

FIELD OF THE INVENTION

The present invention relates to a steam engine having a fluid container, in which working fluid is filled and the working fluid is vibrated in the fluid container in a self-excited vibrating manner as a result of a repeated operation of vaporization and liquefaction of the working fluid by heating and cooling the working fluid.

BACKGROUND OF THE INVENTION

An apparatus for a steam engine is known in the art, for example as disclosed in Japanese Patent Publication No. H7-180649, in which energy is obtained by repeating vaporization and liquefaction of fluid.

In the above apparatus, volatile fluid is filled in a heating chamber, wherein the fluid is vaporized by heating the same and vaporized fluid is introduced into a vertically arranged fluid pipe and guided to an upper portion of the fluid pipe. Then, the vaporized fluid is cooled and liquidized in a cooling chamber provided at the upper portion of the fluid pipe. The liquidized fluid returns to the heating chamber through the fluid pipe. A magnetic member is provided the fluid pipe to cause a movement thereof. An electric power is generated by producing electromotive force at a coil provided at an outside of the fluid pipe.

The applicant of the present invention has proposed a steam engine, as disclosed in Japanese Patent Publication No. 2002-245165 (which corresponds to U.S. patent Publication No. 2004/0060294 A1), in which working fluid in a fluid container is vibrated in a self-excited vibrating manner as a result of a repeated operation of vaporization and liquefaction of the working fluid by heating and cooling the working fluid. And a driving force is obtained from the fluid vibration and finally an electric power is generated by such driving force.

The above steam engine 500 is shown in FIG. 7, which comprises a fluid container 502 having a circular fluid passage, a heating device 504 for heating working fluid in the fluid container 502, a cooling device 506 arranged above the heating device 504 and cooling steam vaporized at the heating device 504, and an output device 508. The output device 508 comprises a cylinder 510, a piston 512 silidably moving back and forth in the cylinder 510, a moving member 514 connected at its one end to the piston 512, and a spring 516 connected to the other end of the moving member 514. The piston 512 is moved in the cylinder 510 in a reciprocating manner in accordance with pressure from the working fluid.

In the above steam engine 500, volumetric expansion of the working fluid occurs in the fluid container 502, when the working fluid is heated and vaporized by the heating device 504. The vaporized steam heated at the heating device 504 moves upwardly toward the cooling device 506, at which the steam is cooled and liquidized. Volumetric contraction of the working fluid in the fluid container 502 occurs by the liquefaction of the working fluid. The piston 512 and the moving member 514 of the output device 508 are reciprocated by change of liquid surface (self-excited vibration) as the pressure change due to the volumetric expansion and contraction of the working fluid in the fluid container 502.

Accordingly, electromotive force is generated and thereby electric power can be generated by the reciprocal movement of the piston 512 and the moving member 514, when a permanent magnet is fixed to the moving member 514 and a coil is provided at a position opposing to the permanent magnet.

It is, however, disadvantageous in the above steam engine 500, in that thermal efficiency is not sufficiently high.

Namely, when the vaporized steam produced at the heating device 504 moves upwardly, liquid-phase working fluid directly below the steam also moves upwardly and passes through the heating device 504, so that such working fluid may be heated by the heating device 504 to a temperature at which the fluid can not be vaporized.

In the case that the working fluid passing through the heating device 504 is heated but not vaporized, thermal energy supplied to the working fluid passing through the heating device 504 as the liquid-phase working fluid does not contribute to the volumetric expansion of the working fluid in the fluid container 502, and thereby such energy can not be used for the reciprocal movement of the piston 512 and the moving member 514.

As above, a part of the thermal energy is unnecessarily wasted in the above steam engine 500, the thermal efficiency is decreased corresponding to such wasted thermal energy.

SUMMARY OF THE INVENTION

Accordingly, it is an object of the present invention to provide a steam engine, in which working fluid in a fluid container is vibrated in a self-excited vibrating manner as a result of a repeated operation of vaporization and liquefaction of the working fluid by heating and cooling the working fluid, and in which thermal efficiency is improved.

According to a feature of the present invention, a heating device and a cooling device are provided at a fluid container in which working fluid is filled at a predetermined pressure. The fluid container has a vertically extending outer pipe having an upper closed end, and an inner pipe provided in the outer pipe and having a fluid inlet port through which the inside of the inner pipe is operatively communicated with the outside of the inner pipe. The inner pipe has a pressure control device at its lower end, and a fluid injection port at its upper end for injecting the working fluid in the inner pipe into a space defined between the inner pipe and the outer pipe, when the pressure in the inner pipe is increased by the pressure control device.

According to the above feature of the present invention, the working fluid injected from the inner pipe into the space between the inner and outer pipes is heated and vaporized by the heating device, so that volumetric expansion of the working fluid takes place to increase fluid pressure in the fluid container. The vaporized steam is then cooled and liquidized by the cooling device and thereby the volumetric contraction takes place, so that the fluid pressure is decreased. By repeating the above volumetric expansion and contraction of the working fluid by the heating and cooling devices, the pressure change is given to the working fluid in the fluid container.

The vaporization of the working fluid is performed in the closed circular space defined by the outer and inner pipes, and the closed circular space is formed at a vertically higher position close to the upper end of the outer pipe. And therefore, the steam vaporized by the heating device is prevented from moving upwardly away from the heating device.

Furthermore, the liquid-phase working fluid directly below the steam is prevented from being heated but not vaporized by the heating device and upwardly passing through the heating device. As a result, heat efficiency of the steam engine is improved

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS (First Embodiment)

A first embodiment of the present invention will now be explained with reference to the drawings.

Figure 1:
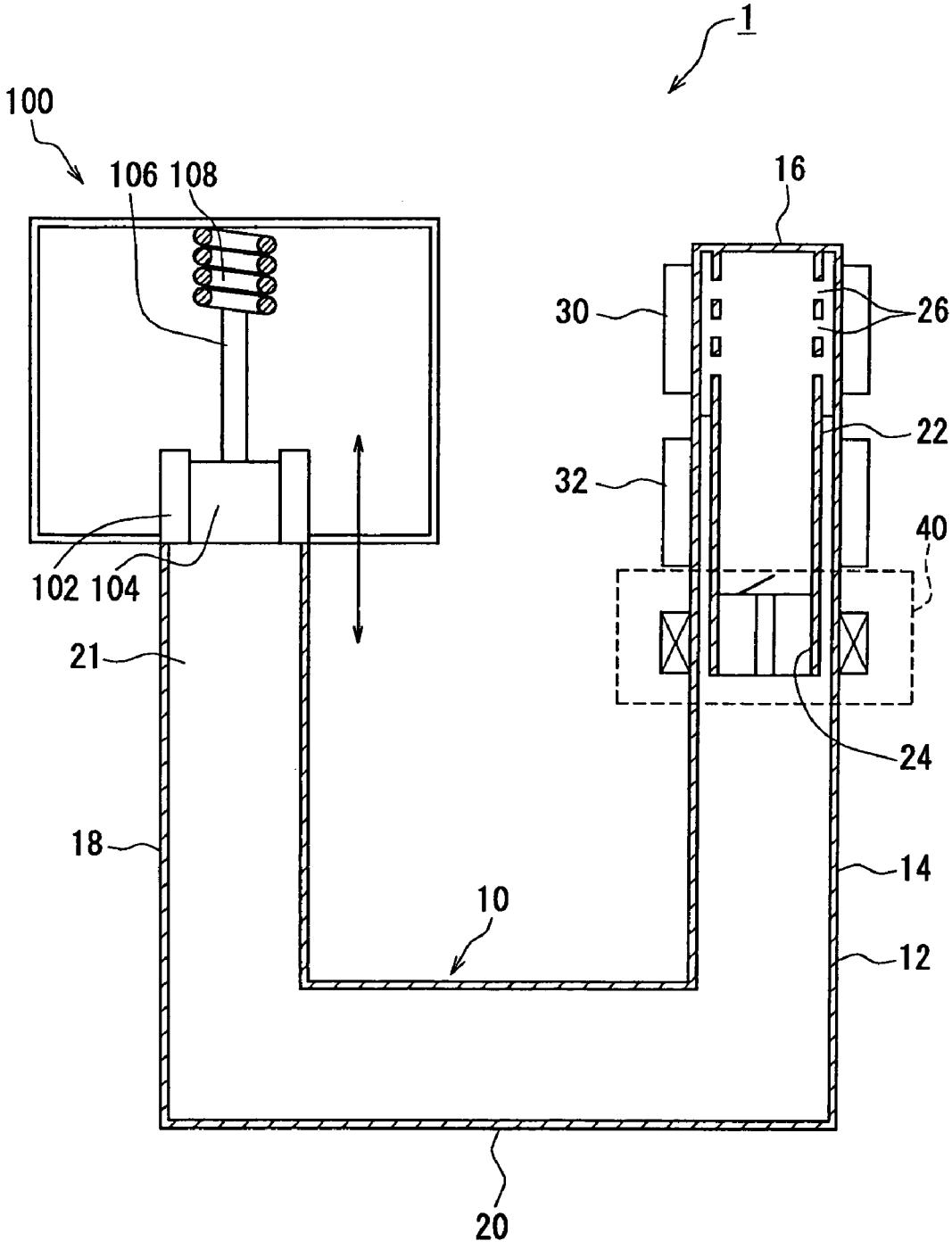
FIG. 1 is a schematic view showing a steam engine according to a first embodiment of the present invention.

As shown in FIG. 1, a steam engine 1 comprises a fluid container 10 in which working fluid, such as water, is filled with a predetermined pressure, a heating device 30, a cooling device 32, a pressure control device 40 for increasing or decreasing fluid pressure, and an output device 100 for generating energy as a driving force.

The fluid container 10 comprises an outer pipe 12 and an inner pipe 22, wherein the outer pipe 12 is formed into a U-shaped pipe having a bottom pipe portion 20 and a pair of (first and second) vertically extending straight pipe portions 14 and 18 extending from both ends of the bottom pipe portion 20.

The first straight pipe portion 14 has an upper closed end 16 at its upper end, and the inner pipe 22 vertically extending is provided in the first straight pipe portion 14, wherein an upper end of the inner pipe 22 is fixed to an inner surface of the closed end 16, while a lower end of the inner pipe 22 is opened to the inside of the outer pipe 12 to form an opening portion 24. Multiple fluid injection ports 26 are formed at a side wall portion of the inner pipe 22 adjacent to the upper closed end 16 for communicating the inside and outside spaces of the inner pipe 22.

The heating device 30 is composed of, for example, a heat exchanger, for partly heating and vaporizing the working fluid in the fluid container 10. The cooling device 32 is likewise composed of, for example, a heat exchanger for cooling and liquidizing the steam vaporized by the heating device 30. The heating device 30 is provided at an outer periphery of the first straight pipe portion 14 adjacent to the upper closed end 16, which is also close to the multiple fluid injection ports 26 formed at the inner pipe 22. The cooling device 32 is also provided at the outer periphery of the first straight pipe portion 14 at a vertically lower position than the heating device 30. In this embodiment, the vertical position for the cooling device 32 is vertically higher than a position of a lower end of the inner pipe 22 (the opening portion 24).

A part of the first pipe portion 14, at which the heating device 30 and the cooling device 32 are provided, is made of such a metal, copper, aluminum and the like, as having high heat conductivity, to effectively perform a heating operation by the heating device 30 and a cooling operation by the cooling device 32. The other part of the outer pipe 12 is preferably made of heat insulating material. Furthermore, the inner pipe 22 is made of the heat insulating material to suppress heat exchange between the working fluid in the inner pipe 22 and the heating device 30 and the cooling device 32.

The pressure control device 40 is provided at the first straight pipe portion 14 for generating a pressure change in the working fluid held in the inner pipe 22. Although, the detail structure and operation of the pressure control device 40 is explained later, the working fluid held in the inner pipe 22 is injected through the multiple fluid injection ports 26 into a circular space defined by the inner pipe 22 and the first pipe portion 14, when the pressure of the working fluid in the inner pipe 22 is increased to a predetermined value by the pressure control device 40.

The output device 100 is provided at an upper end 21 of the second pipe portion 18 and generates the electric power in accordance with change of the liquid level (the self-excited level change) appearing at the upper end 21.

The output device 100 comprises a cylinder 102 connected to the upper end 21 of the second straight pipe portion 18, a piston 104 silidably moving back and forth in the cylinder 102, a moving member 106 connected at its one end to the piston 104, and a spring 108 connected to the other end of the moving member 106. A permanent magnet (not shown) is fixed to the moving member 106, and a coil (not shown) is provided at a position opposing to the permanent magnet. The piston 104 and the moving member 106 are reciprocated (moved upwardly and downwardly) in accordance with pressure change of the working fluid in the fluid container 10 (the change of the liquid level at the upper end 21 of the pipe portion 18). The electromotive force and thereby the electric power is generated at the coil of the output device 100 in accordance the reciprocal movement of the moving member 106.

The pressure control device 40 is explained with reference to FIGS. 2A and 2B.

The pressure control device 40 comprises a moving element 42, an energizing coil 50, a stator 52, inside magnetic elements 54*a*, 54*b* and a spring 56. The moving element 42 is movably arranged in the inner pipe 22, and it generates a pressure change to the working fluid in the inner pipe 22 by its reciprocal movement in upward and downward directions.

A fluid inlet port 44 is formed at a center of the moving element 42 for communicating the spaces above and below the moving element 42 with each other.

A one way valve 46 is provided at the fluid inlet port 44, so that the fluid inlet port 44 is opened to allow the working fluid to flow into the inside of the inner pipe 22, when the pressure of the working fluid in the inner pipe 22 is decreased by the downward movement of the moving element 42, while the fluid inlet port 44 is closed to prevent the working fluid from flowing into the inside space of the inner pipe 22 (namely, to prevent the working fluid from flowing out from the inside of the inner pipe 22), when the pressure of the working fluid in the inner pipe 22 is increased by the upward movement of the moving element 42.

A pair of guide members 48 is provided to the moving element 42, each forward end 48*a*, 48*b* of which is inserted into the circular space defined by an inner peripheral surface of the outer pipe 14 and an outer peripheral surface of the inner pipe 22 when the moving element 42 is upwardly moved to its uppermost position. Each of the forward ends 48*a* and 48*b* is formed into an arc shape to form arc spaces between the forward ends 48*a* and 48*b*, so that the working fluid may flow from the inside of the outer pipe 14 below the moving element 42 to the circular space and vice versa, as shown in FIG. 2B.

The energizing coil 50 is an electromagnetic solenoid coil of a ring shape provided at an outer peripheral surface of the outer pipe 14 at such a position, at which the energizing coil 50 is opposed to the moving element 42.

Figure 2A:
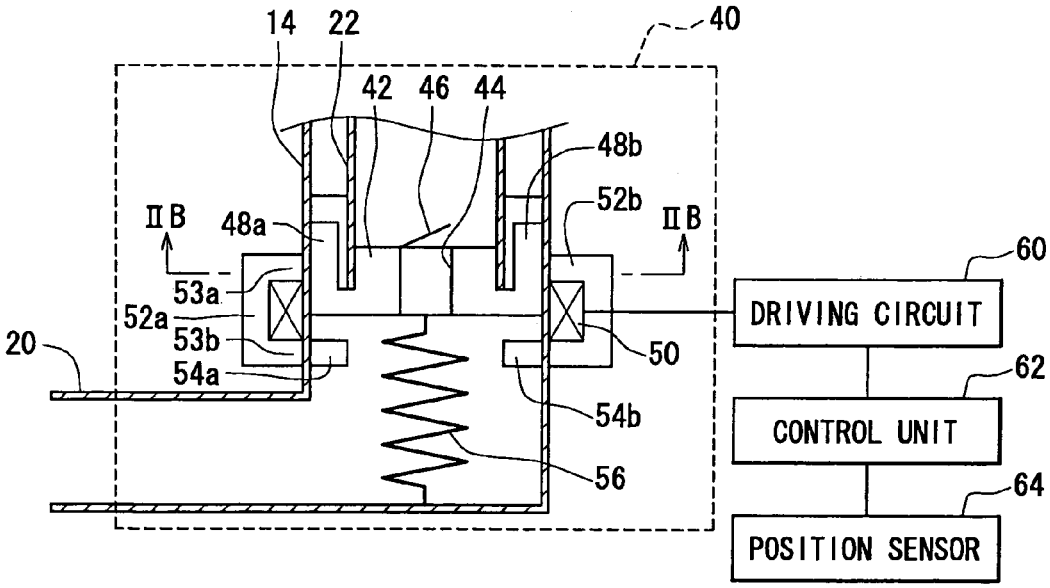
FIG. 2A is a schematic cross sectional view of a pressure control device of the first embodiment.
Figure 2B:
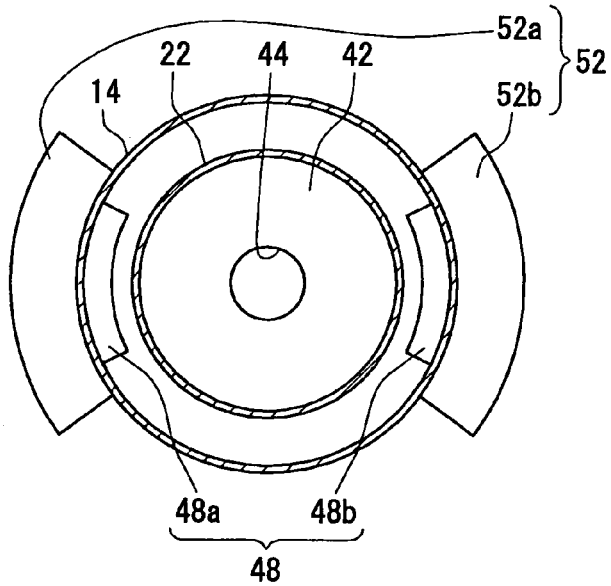
FIG. 2B is a schematic cross sectional view taken along a line IIB—IIB of FIG. 2A.

The stator 52 comprises a pair of arc-shaped stator elements 52*a* and 52*b* provided at the outer peripheral surface of the outer pipe 14 at such a position, at which the stator elements 52*a* and 52*b* are respectively opposed to the guide members 48*a* and 48*b*, as shown in FIG. 2B. Each of the arc-shaped stator elements 52*a* and 52*b* has a U-shaped cross sectional configuration, as shown in FIG. 2A, wherein the ring-shaped solenoid coil 50 is housed in arc-shaped grooves of the stator elements 52*a* and 52*b*. Each of the arc-shaped stator elements 52*a* and 52*b* further has an upper end 53*a* and a lower end 53*b* facing to the outer peripheral surface of the outer pipe 14.

The pair of inside magnetic elements 54*a* and 54*b* is fixed to the inner surface of the outer pipe 14 at such a position opposing to the respective lower ends 53*b* of the stator elements 52*a* and 52*b*.

Accordingly, an electromagnetic path is formed by the upper ends 53*a* of the stator element 52*a* and 52*b*, the guide members 48*a* and 48*b*, the inside magnetic elements 54*a* and 54*b*, and the lower ends 53*b* of the stator elements 52*a* and 52*b*, when the electric power is supplied to the solenoid coil 50.

The spring 56 is connected at its one end with the moving element 42 and at its other end with the inner surface of the outer pipe 14, for upwardly urging the moving element 42, so that the moving element 42 is placed at its upper-most position by the spring force of the spring 56, as shown in FIG. 2A, when the electric power supply to the solenoid coil 50 is cut off.

The solenoid coil 50 is connected to a control unit 62 (generally comprising a computer) via a driving circuit 60. A position sensor 64 is provided in the output device 100 to detect positions of the piston 104, and a detected signal from the position sensor 64 is inputted into the control unit 62, so that the control unit 62 controls the electric power supply to the solenoid coil 50 in accordance with the detected position of the piston 104.

When the electric power is supplied to the solenoid coil 50 by the control unit 64, the magnetic field is generated by the solenoid coil 50, and the magnetic poles are thereby formed at the upper and lower ends 53*a* and 53*b* of the stator elements 52*a* and 52*b*. As result, the moving element 42 is pulled down toward the inside magnetic elements 54*a* and 54*b* against the spring force of the spring 56.

In the embodiment, the inner pipe 22 is almost fully filled with the working fluid, when the electric power is supplied to the solenoid coil 50 and thereby the moving element 42 is pulled down to its lowermost position, so that the pressure in the inner pipe 22 is made relatively lower.

Furthermore, in the embodiment, liquid level of the working fluid in the circular space between the inner and the outer pipes 22 and 14 is maintained at such a position vertically lower than the heating device 30, even when the pressure in the inner pipe 22 is made lower. For example, the liquid level is maintained at a position between the heating device 30 and the cooling device 32, as shown in FIG. 1.

An operation of the steam engine 1 according to the first embodiment is explained.

The electric power is supplied to the solenoid coil 50, the moving element 42 is pulled down to its lowermost position and the pressure in the inner pipe 22 is made lower, as explained above. Then, the electric power supply to the solenoid coil 50 is cut off by the operation of the control unit 62, so that the moving element 42 moves up by the spring force of the spring 56 toward its uppermost position.

In this operation, the one way valve 46 is closed to prevent the working fluid from flowing into the inside of the inner pipe 22, and the pressure of the working fluid in the inside of the inner pipe 22 is rapidly increased in accordance with the upward movement of the moving element 42.

The working fluid in the inside of the inner pipe 22 is injected from the multiple fluid injection ports 26 into the circular space defined by the outer pipe 14 and the inner pipe 22, when the pressure of the working fluid in the inside of the inner pipe 22 is increased as above.

Since the fluid injection ports 26 are formed in the inner pipe 22 adjacent to the heating device 30, the working fluid injected from the fluid injection ports 26 are heated and vaporized by the heating device 30. As a result, the working fluid in the circular space is volumetrically expanded due to the vaporization of the injected working fluid, and thereby the working fluid in the fluid container 10 is volumetrically expanded.

When the volumetric expansion of the working fluid occurs as above, the liquid level of the working fluid in the circular space between the inner pipe 22 and the outer pipe 14 is pulled down and the liquid level at the upper end 21 of the second straight pipe portion 18 is pushed up. The piston 104 and the moving member 106 of the output device 100 are thereby upwardly moved in accordance with the upward movement of the liquid level at the upper end 21.

A lower part of the steam vaporized by the heating device 30 moves downwardly, even below the heating device 30, in accordance with the volumetric expansion by the vaporization. The lower part of the steam reaches a vertical position at which the cooling device 32 is provided.

Then, the steam is cooled and liquidized by the cooling device 32. The working fluid at the cooling device 32 is contracted due to the liquefaction and thereby the working fluid in the fluid container 10 is contracted as a whole.

When the volumetric contraction of the working fluid occurs as above, the liquid level of the working fluid in the circular space between the inner pipe 22 and the outer pipe 14 goes up and the liquid level at the upper end 21 of the second straight pipe portion 18 goes down. The piston 104 and the moving member 106 of the output device 100 are likewise downwardly moved in accordance with the downward movement of the liquid level at the upper end 21.

The above upward and downward movement (the reciprocal movement) of the piston 104 and the moving member 106 is repeated as the result of repeated changes of the liquid level (the self-excited displacement) at the upper end 21 of the second straight pipe portion 18, so that the electric power is generated at the output device 100.

The above operation is further explained in detail. The control unit 62 cuts off the electric power supply to the solenoid coil 50, when it detects that the moving element 106 starts its downward movement from its top dead point based on the signal from the position sensor 64. Then, the moving element 42 is upwardly moved to inject the working fluid from the fluid injection ports 26. The injected fluid is heated and vaporized by the heating device 30 to cause the volumetric expansion of the working fluid. As a result, the driving force for the upward movement is applied to the moving member 106, when the moving member 106 reaches its bottom dead point.

A time period for cutting off the electric power supply to the solenoid coil 50 is in advance determined by the control unit 62, so that an optimum amount of the working fluid is injected from the fluid injection ports 26.

The electric power is supplied to the solenoid coil 50 during a period in which the moving member 106 is upwardly moved from its bottom dead point. During this upward movement of the moving member 106, the moving element 42 is downwardly moved to decrease the pressure of the working fluid in the inner pipe 22, so that the fluid inlet port 44 is opened and the working fluid flows into the inside of the inner pipe 22.

When the part of the steam is cooled and liquidized by the cooling device 32 and thereby the working fluid is contracted, the moving member 106 starts again its downward movement. Then the control unit 62 stops the electric power supply to the solenoid coil 50 based on the signal from the position sensor 64.

As above, the moving member 106 is repeatedly reciprocated to generate the electric power at the output device 100.

The steam engine 1 of the above embodiment has the following features and advantages.

(1) The vaporization of the working fluid is performed in the closed circular space defined by the outer and inner pipes 14 and 22, and the closed circular space is formed at a vertically higher position close to the upper end 16 of the straight pipe portion 14. And therefore, the steam vaporized by the heating device 30 is prevented from moving upwardly away from the heating device 30.

Furthermore, the liquid-phase working fluid directly below the steam is prevented from being heated but not vaporized by the heating device 30 and upwardly passing through the heating device 30. As a result, heat efficiency is improved by such a degree in which the above phenomenon is suppressed.

(2) The inner pipe 22 is made of the heat insulating material, and only the working fluid adjacent to the heating device 30 is heated, so that such working fluid is vaporized to further improve the heat efficiency.

(3) When the moving element 42 is downwardly moved and thereby the pressure in the inside of the inner pipe 22 is made lower, the inside of the inner pipe 22 is fully filled with the liquid-phase working fluid. Therefore, when the moving element 42 is upwardly moved to increase the pressure of the working fluid in the inner pipe 22, the working fluid is rapidly injected from the fluid ports 26 into the circular space defined by the inner pipe 22 and the outer pipe 14. The response of the steam engine 1 (the injection of the working fluid due to the upward movement of the moving element 42) is improved.

(4) The one way valve 46 is provided at the fluid inlet port 44, so that the fluid inlet port 44 is opened when the moving element 42 is downwardly moved, while it is closed when the moving element 42 is upwardly moved. Accordingly, the working fluid is smoothly supplied into the inner pipe 22, whereas the pressure of the fluid in the inner pipe 22 can be rapidly increased, in accordance with the downward and upward movement of the moving element 42.

(5) Furthermore, the liquid level of the working fluid in the circular space between the inner pipe 22 and the outer pipe 14 is kept at the position vertically lower than the heating device 30, when the moving element 42 is downwardly moved and the pressure in the inner pipe 22 is made lower. Accordingly, there exists only the working fluid at the heating device 30 when the working fluid is injected from the fluid injection ports 26, and thereby the heat of the heating device 30 is effectively transmitted to the injected working fluid to facilitate the vaporization. As a result, the heat efficiency of the steam engine 1 is further improved due to the rapid vaporization of the working fluid.

(6) The cooling device 32 is provided at a position vertically higher than the lower end of the inner pipe 22, so that the working fluid (the steam) can be rapidly cooled and condensed to improve its cooling efficiency.

(7) Multiple fluid injection ports 26 are provided at the inner pipe 22, so that a sufficient amount of the working fluid can be injected through such fluid injection ports 26 during a short period of time. Since the large amount of the working fluid can be vaporized during the short time period, the frequency of the self-excited displacement can be correspondingly increased.

(8) Since the guide members 48*a*, 48*b* made of magnetic material are fixed to the moving element 42, the moving element 42 can be quickly moved in the downward direction. Furthermore, since the inside magnetic elements 54*a*, 54*b* are provided in the inner surface of the outer pipe 14, the downward movement of the moving element 42 can be further effectively done.

(9) The spring 56 is provided to upwardly move the moving element 42, when the electric power supply to the solenoid coil 50 is cut off. And therefore, energy efficiency is improved.

(10) The movement of the moving element 42 is controlled by the control unit 62 based on the detected position signal for the piston 104 (and/or the moving member 106) provided in the output device 100, so that the movement of the moving element 42 is synchronized with the movement of the piston 104, to improve the efficiency of the electric power generation.

The above described first embodiment can be modified in various manners, as below.

The inner pipe 22 can be made of such material having lower heat conductivity than the outer pipe 14, instead of the heat insulating material.

The moving element 42 can be arranged so that its downward movement is carried out by a spring force, during which the electric power supply is stopped. The upward movement of the moving element 42 is then carried out by the electromagnetic force.

A permanent magnet can be used as, or additionally fixed to, the guide members 48*a*, 48*b*. In this modification, the moving element 22 is moved up and down by attracting or bouncing forces between the guide members 48 and the magnetic poles formed at the stator 52. As a result, the spring 56 can be eliminated. The inside magnetic elements 54*a,* 54*b* are used as stoppers for limiting the downward movement of the moving element 42.

(Second Embodiment)

Figure 3A:
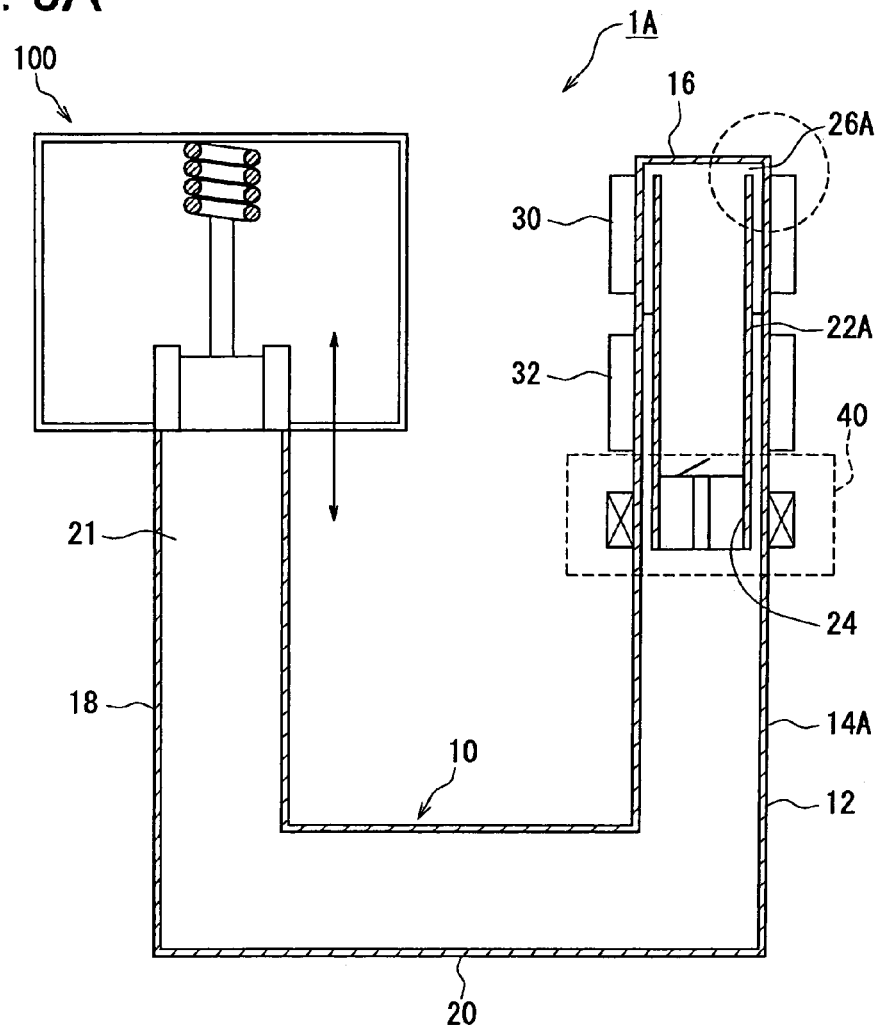
FIG. 3A is a schematic view showing a steam engine according to a second embodiment.
Figure 3B:
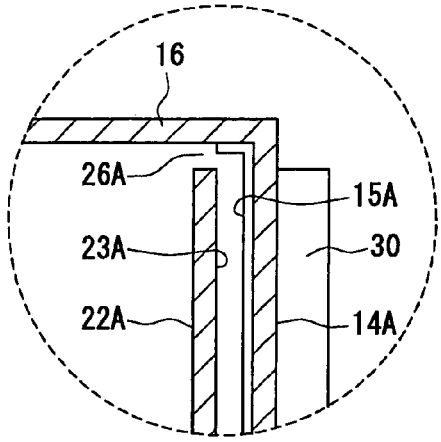
FIG. 3B is an enlarged cross sectional view showing a portion circled in FIG. 3A.

A second embodiment of the present invention is explained with reference to FIGS. 3A and 3B.

The second embodiment differs from the first embodiment in the following points.

Multiple fluid injection ports 26A are provided at an upper end of an inner pipe 22A. An inside surface of an outer pipe 14A adjacent to the heating device 30 is formed as a hydrophilic surface 15A, as shown in FIG. 3B. And an outside surface of the inner pipe 22A adjacent to the heating device 30 is formed as a water repellent surface 23A.

The above hydrophilic surface and water-repellent surface can be formed by the following methods (but not limited to those methods). The upper end portions of the outer pipe 14A and the inner pipe 22A are manufactured respectively by those materials having the hydrophilic characteristic and the water-repellent characteristic. Coating material respectively having those characteristics can be coated on the surfaces of the outer pipe 14A and the inner pipe 22A. Or, the surface-roughness of the respective surfaces is adjusted.

The steam engine 1 of the above second embodiment has the following features and advantages, in addition to those of the first embodiment.

(1) The working fluid injected or flowing out from the multiple fluid injection ports 26A downwardly flows on and along the inside surface 15A of the outer pipe 14A. The liquid-phase working fluid can be held on the inside surface 15A for a longer time period, and thereby heated and surely vaporized. Furthermore, the liquid-phase working fluid is widely spread over the inside surface 15A adjacent to the heating device 30 due to capillary forces, because the inside surface 15A is formed as the hydrophilic surface.

(2) The working fluid injected or flowing out from the multiple fluid injection ports 26A and adhered to the outside surface 23A quickly flows downwardly along the outside surface 23A, because it is formed as the water-repellent surface. Accordingly, the amount of the working fluid which would be heated but not be vaporized by the heating device 30 can be reduced, to further improve the heat efficiency of the steam engine 1.

Figure 4:
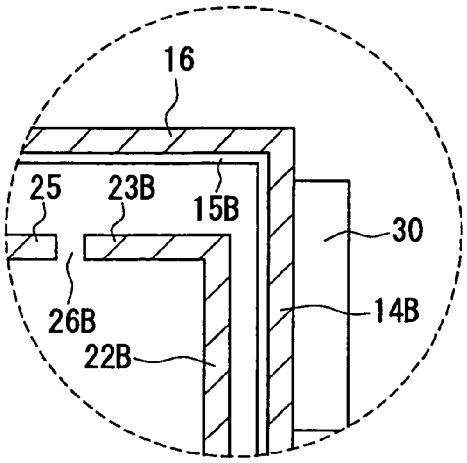
FIG. 4 is an enlarged cross sectional view showing the portion circled in FIG. 3A according to a modification of the second embodiment of the present invention.

The inner pipe 22A and the outer pipe 14A can be modified to an inner pipe 22B and an outer pipe 14B, as shown in FIG. 4, wherein the inner pipe 22B is provided with a top end portion 23B for closing an upper top portion 25 of the inner pipe 14B, and a fluid injection port 26B (multiple fluid ports) is formed at the top end portion 23B. In this modification, the inner pipe 22B is fixed to the outer pipe 14B by any suitable means (not shown).

An inside surface of the upper closed end 16 and side wall of the outer pipe 14B adjacent to the heating device 30 is formed as the hydrophilic surface 15B, while an outside surface of the upper top portion 25 and a side wall of the inner pipe 22B adjacent to the heating device 30 is formed as a water-repellent surface.

In such modification, the working fluid flowing out of the fluid injection ports 26B is formed into liquid drops of spherical configuration due to the water-repellent characteristic at the outside surface of the upper top portion 25. The liquid drops will grow up to larger liquid drops and come in contact with the inside surface 15B (the hydrophilic surface) of the outer pipe 14B.

The liquid-phase working fluid becoming in contact with the inner surface 15B is spread over to the inside surface of the side wall of the outer pipe 14B, due to the capillary force.

As above, the working fluid from the fluid injection ports 26B can be effectively heated and vaporized by the heating device 30. And the working fluid is further prevented from staying for a longer time period on the outside surface of the inner pipe 22B, because of the water-repellent surface.

(Third Embodiment)

Figure 5:
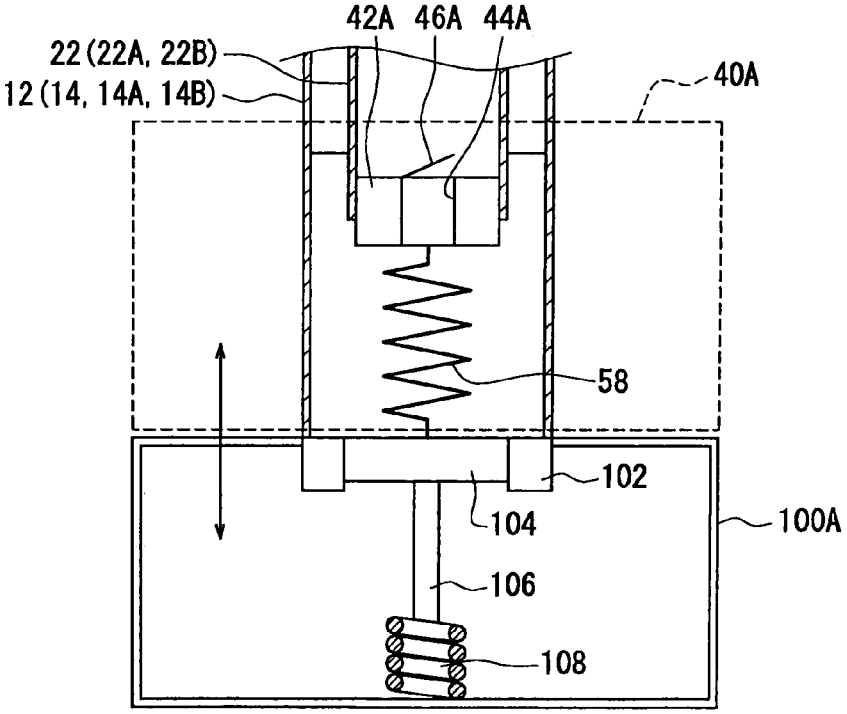
FIG. 5 is a schematic cross sectional view showing a pressure control device according to a third embodiment of the present invention.

A third embodiment of the present invention is explained with reference to FIG. 5, showing a modified pressure control device 40A. Although the outer pipe 12 is indicated as a straight pipe in FIG. 5, it can be a U-shaped pipe as in the same manner to the first embodiment.

The third embodiment differs from the first or second embodiment in the structure of the pressure control device 40A.

The pressure control device 40A comprises a moving element 42A and a spring 58 connected at its one end to the moving element 42A and at its other end to the moving member 106 of the output device 100A via the piston 104. The pressure change in the inside of the inner pipe 22 (22A, 22B) is generated by the reciprocal movement of the moving element 42A in the inner pipe 22.

A fluid inlet port 44A and a one way valve 46A, which are the same or similar to the first embodiment, are also provided to the moving element 42A. The guide members 48*a,* 48*b* of the first embodiment are eliminated in this embodiment. Furthermore, such components corresponding to the solenoid coil 50, the stator 52, the inside magnetic elements 54*a,* 54*b,* and the spring 56 in the first embodiments, are not provided in the pressure control device 40A.

Even in the above simplified embodiment, the movement of the moving element 42A can be synchronized with the movement of the moving member 106 (the piston 104) depending on spring characteristic, such as a spring constant or the like, to generate the electric power in a preferred mode.

A start-up assisting means can be added to the above third embodiment, to smoothly start up the operation of the steam engine 1. For example, an electromagnetic coil is provided in the output device 100A, and the electric power is supplied to the coil only during a stat-up period of the steam engine. In this modification, the moving member 106 and the piston 104 are vertically moved by the electromagnetic force of the coil at the start-up period, and thereafter the steam engine continues its operation by itself.

(Fourth Embodiment)

Figure 6:
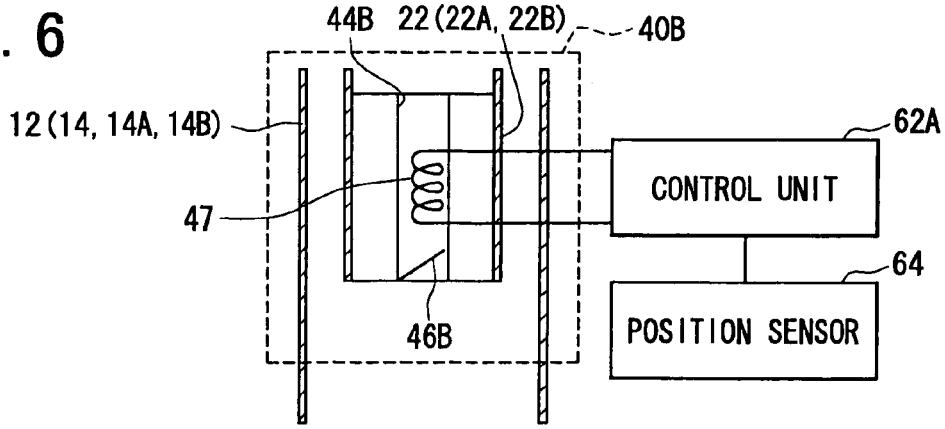
FIG. 6 is an enlarged partial view schematically showing a pressure control device according to a fourth embodiment of the present invention.
Figure 7:
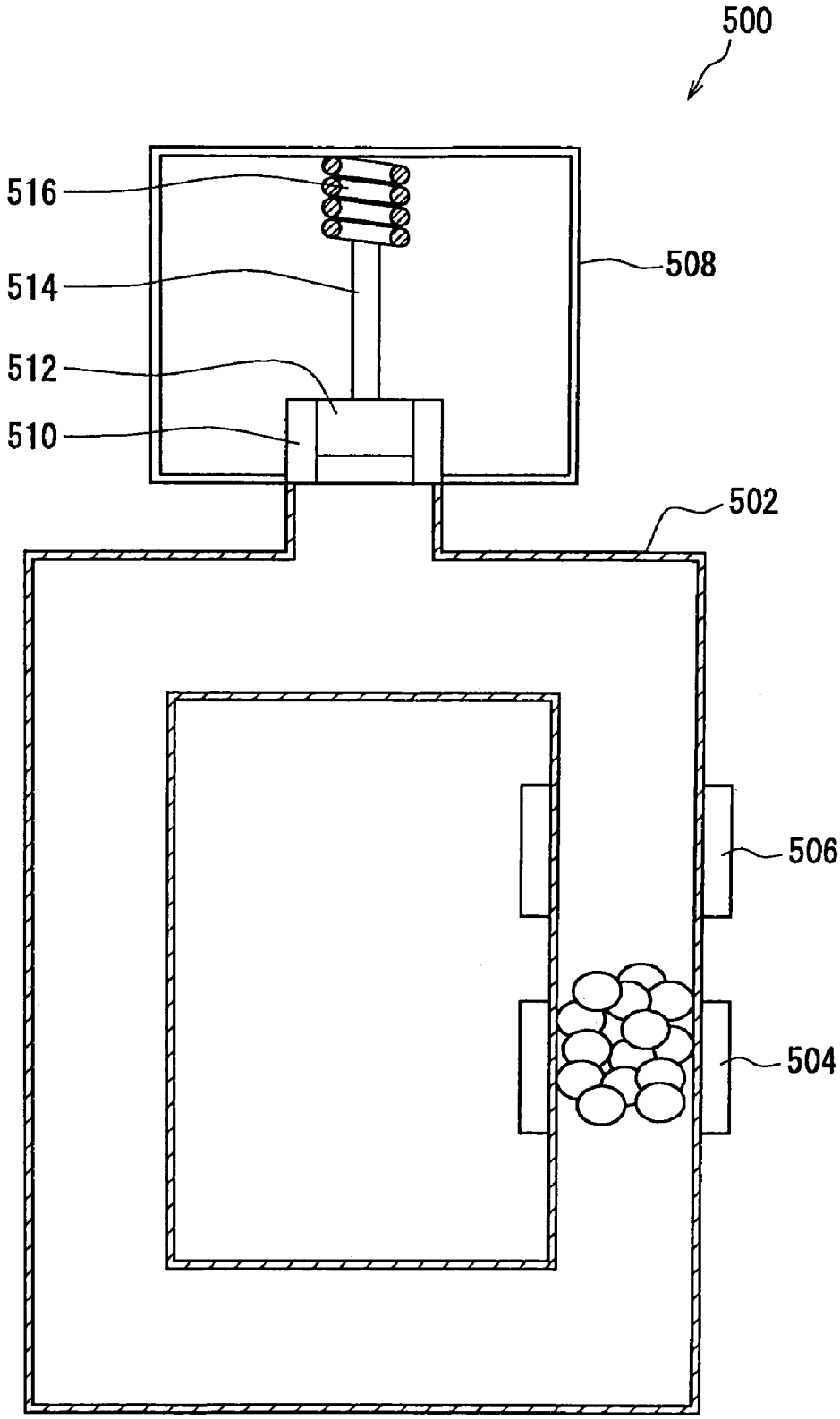
FIG. 7 RELATED ART
FIG. 7 is a schematic view showing a steam engine of a related art.

A fourth embodiment of the present invention is explained with reference to FIG. 6, showing a modified pressure control device 40B.

The fourth embodiment differs from the first or second embodiment in the structure of the pressure control device 40B.

The pressure control device 40B comprises a fixed element fixed to the lower end of inner pipe 22 (or 22A, 22B), a one way valve 46B provided at a lower end of a fluid inlet port 44B, and a heating coil 47 provided in the fluid inlet port 44B and controlled by a control unit 62A. According to this embodiment, the working fluid is heated and vaporized by the heating coil 47 in the fluid inlet port 47, to increase the pressure in the inner pipe 22. The steam (the vaporized working fluid by the heating coil 47) is cooled and condensed by the liquid-phase cold working fluid in the inner pipe 22, when the steam goes up in the inner pipe 22.

The position signal for the piston 104 is inputted into the control unit 62A from the position sensor 64, and the control unit 62A controls the heating operation by the heating coil 47 in accordance with the detected position signal.

The control operation is explained below more in detail. The control unit 62A starts the heating operation by the heating coil 47, when it detects from the position signal of the position sensor 64 that the moving member 106 (as well as the piston 104) starts its downward movement from its top dead point. The pressure in the inner pipe 22 is increased and the lower end of the fluid inlet port 44B is closed by the one way valve 46B. The working fluid in the inner pipe 22 is injected from the fluid injection ports 26 (or 26A, 26B) into the circular space, as in the same manner to the first embodiment, at such a timing at which the moving member 106 is about to reach its bottom dead point. Then the injected working fluid is heated and vaporized by the heating device 30 to generate the volumetric expansion of the working fluid, and to increase the pressure of the fluid in the fluid container 10.

A time period for heating the fluid in the fluid inlet port 44B by the heating coil 47 is memorized in advance and controlled by the control unit 62A, so that an amount of the working fluid to be injected from the fluid injection ports 26 is controlled at an optimum amount. The heating operation by the heating coil 47 is stopped by the operation of the control unit 62A during a period in which the moving member 106 is upwardly moving from its bottom dead point. In this period, the pressure in the inner pipe 22 becomes relatively lower, so that the one way valve 46B is opened and the working fluid flows into the inside of the inner pipe 22.

When the vaporized steam by the heating device 30 is cooled and condensed by the cooling device 32, the volumetric contraction starts and thereby the moving member 106 starts again its downward movement. The heating coil 47 is again heated by the control unit 62A.

According to the fourth embodiment, the electric power is generated at the output device 100 by repeating the above operation (the reciprocal movement of the moving member 106 and the piston 104).

According to the above fourth embodiment, the pressure change in the inner pipe 22 can be carried out by the heating coil 47. Since the moving element 42 (or 42A) is not necessary in this embodiment, the steam engine 1 can be made simpler than the first or second embodiment. The same effect to the first embodiment can be also obtained in the fourth embodiment.

What is claimed is:

1. A steam engine comprising:

a fluid container in which working fluid is filled and the working fluid can move;

a heating device for heating the working fluid in the fluid container and vaporizing the working fluid; and a cooling device for cooling down and liquidizing the steam vaporized by the heating device, wherein self-excited movement of the working fluid in the fluid container is generated by a repeated operation of vaporization and liquefaction of the working fluid by the heating device and the cooling device, wherein the fluid container comprises;

a vertically extending outer pipe having an upper closed end at its upper end, the heating device and the cooling device being provided at an outer peripheral surface of the outer pipe and the heating device being arranged at a vertically higher than the cooling device;

an inner pipe provided in the outer pipe and having a fluid inlet port for operatively communicating the inside of the inner pipe with the outside thereof;

a pressure control device provided at a lower end of the inner pipe for opening and closing the fluid inlet port;

a fluid injection port provided at an upper portion of the inner pipe for injecting the working fluid into a space defined by the outer pipe and the inner pipe, when pressure in the inner pipe is increased.

2. A steam engine according to claim 1, wherein multiple fluid injection ports are provided at the upper portion of the inner pipe.

3. A steam engine according to claim 1, wherein an upper end of the inner pipe is fixed to an inside surface of the upper closed end of the outer pipe, and the fluid injection port is formed at a side wall of the inner pipe close to its upper end.

4. A steam engine according to claim 1, wherein an inside surface of the outer pipe adjacent to the heating device is formed by hydrophilic surface.

5. A steam engine according to claim 1, wherein an outside surface of the inner pipe adjacent to the heating device is formed by a water-repellent surface.

6. A steam engine according to claim 1, wherein the inner pipe is made of heat insulating material.

7. A steam engine according to claim 1, wherein the inner pipe has a lower heat conductivity than the outer pipe.

8. A steam engine according to claim 1, wherein the inner pipe is almost fully filled with liquid-phase working fluid when the pressure in the inner pipe becomes lower.

9. A steam engine according to claim 1, wherein a liquid level of the working fluid in the space defined by the inner pipe and the outer pipe is kept at a position vertically lower than the heating device, when the pressure in the inner pipe is controlled at a lower pressure by the pressure control device and no working fluid is injected from the fluid injection port.

10. A steam engine according to claim 1, wherein the cooling device is provided at the outer peripheral surface of the outer pipe at a position vertically higher than a lower end of the inner pipe.

11. A steam engine according to claim 1, wherein the pressure control device comprises;

a moving element for applying a pressure change to the working fluid in the inner pipe by its reciprocal movement; and a driving means for driving the moving element so that the moving element reciprocates in the inner pipe.

12. A steam engine according to claim 11, wherein the moving element has a guide member made of magnetic material; and the driving means drives the moving element by electromagnetic force.

13. A steam engine according to claim 12, wherein the driving means comprises;

a ring shaped electromagnetic coil provided at the outer peripheral surface of the outer pipe, to generate the electromagnetic force and drive the moving element by the electromagnetic force.

14. A steam engine according to claim 13, wherein the moving element has the guide member made of magnetic material, and the guide member is inserted into the space defined by the outer pipe and the inner pipe.

15. A steam engine according to claim 14, wherein the driving means comprises;

a stator provided at an outer periphery of the electromagnetic coil and having magnetic pole portions facing to the outer peripheral surface of the outer pipe, the magnetic poles being formed at the magnetic pole portions when electric power is supplied to the electromagnetic coil.

16. A steam engine according to claim 14, wherein the guide member has a permanent magnet.

17. A steam engine according to claim 11, further comprising:

a spring for urging the moving element in a direction to hold the moving element at a predetermined position.

18. A steam engine according to claim 1, wherein the pressure control device comprises a heating means for heating the working fluid in the inner pipe to increase the pressure in the inner pipe and thereby to inject the working fluid from the fluid injection port into the space defined by the outer pipe and the inner pipe.

19. A steam engine according to claim 1, further comprising:

an output device for generating energy in accordance with the self-excited displacement of the working fluid.

20. A steam engine according to claim 19, wherein the output device comprises a moving member, which is reciprocated in accordance with the self-excited displacement of the working fluid for generating energy.

21. A steam engine according to claim 20, further comprising:

a position sensor for detecting a position of the moving member; and a control unit for controlling an operation of the pressure control device in accordance with detected position of the moving member from the position sensor.

22. A steam engine according to claim 1, further comprising:

an output device for generating energy in accordance with the self-excited displacement of the working fluid, the output device comprising a moving member, which is reciprocated in accordance with the self-excited displacement of the working fluid, wherein the pressure control device comprises a moving element for applying a pressure change to the working fluid in the inner pipe by its reciprocal movement; and a spring connected between the moving member and the moving element.

23. A steam engine according to claim 1, further comprising:

a one way valve for opening the fluid inlet port when the pressure in the inner pipe is made lower by the pressure control device, so that the working fluid flows into the inner pipe, the one way valve closing the fluid inlet port when the pressure in the inner pipe is made higher by the pressure control device, so that the working fluid is prevented from flowing into the inner pipe.

24. A steam engine according to claim 1, wherein the fluid inlet port is formed in the moving element.

* * * * *